US010415140B2

(12) United States Patent
Van de Cappelle et al.

(10) Patent No.: US 10,415,140 B2
(45) Date of Patent: Sep. 17, 2019

(54) TWO-STAGE PRE-TREATMENT OF ALUMINUM COMPRISING PICKLING AND PASSIVATION

(71) Applicant: Henkel AG & Co. KGaA, Duesseldorf (DE)

(72) Inventors: Mathieu Van de Cappelle, Paris (FR); Ina Kruegermann, Langenfeld (DE); Thomas John-Schillings, Essen (DE); Andrea Soldati, Milan (IT); Andreas Richard Bender, Meitingen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 311 days.

(21) Appl. No.: 15/279,929

(22) Filed: Sep. 29, 2016

(65) Prior Publication Data

US 2017/0016119 A1 Jan. 19, 2017

Related U.S. Application Data

(63) Continuation of application No. PCT/EP2015/057035, filed on Mar. 31, 2015.

(30) Foreign Application Priority Data

Apr. 3, 2014 (DE) ..... 10 2014 206 407

(51) Int. Cl.

| | |
|---|---|
| ***C23C 22/34*** | (2006.01) |
| ***C23C 22/80*** | (2006.01) |
| ***C23C 22/78*** | (2006.01) |
| ***C23G 1/12*** | (2006.01) |
| ***C23G 5/028*** | (2006.01) |
| ***C23C 22/76*** | (2006.01) |

(52) U.S. Cl.

CPC ..... *C23C 22/34* (2013.01); *C23C 22/76* (2013.01); *C23C 22/78* (2013.01); *C23G 1/125* (2013.01); *C23G 5/02864* (2013.01)

(58) Field of Classification Search

CPC ..... C23C 22/34; C23C 22/78–22/80
USPC ..... 148/247
See application file for complete search history.

(56) References Cited

U.S. PATENT DOCUMENTS

| | | | |
|---|---|---|---|
| 6,562,148 | B1 | 5/2003 | Wendel et al. |
| 8,679,586 | B2 | 3/2014 | Czika et al. |
| 8,715,403 | B2 | 5/2014 | Brouwer et al. |
| 2007/0017602 | A1* | 1/2007 | Koch ..... C23C 22/34 148/247 |

FOREIGN PATENT DOCUMENTS

| | | | |
|---|---|---|---|
| CN | 101161861 | A | 4/2008 |
| DE | 19921842 | A1 | 11/2000 |
| DE | 102009047522 | A1 | 6/2011 |
| WO | 9713005 | A1 | 4/1997 |
| WO | 0068458 | A1 | 11/2000 |
| WO | 2010018102 | A1 | 2/2010 |

OTHER PUBLICATIONS

International Search Report for PCT/EP2015/057035, dated Jul. 16, 2015. All references cited in the International Search Report are listed herein.

* cited by examiner

*Primary Examiner* — Lois L Zheng
(74) *Attorney, Agent, or Firm* — Mary K. Cameron

(57) ABSTRACT

A method for anti-corrosion treatment of components produced from aluminum, comprising a pre-treatment stage and subsequent painting. The pre-treatment stage includes steps of pickling and passivation wherein passivation of the components includes contacting them with an acidic, aqueous composition based on water-soluble compounds of the elements Zr and/or Ti. The pickling and passivation are coordinated with each other so that a re-dosing of active components of the passivation solution can occur in substantial parts from the pickling solution.

12 Claims, No Drawings

TWO-STAGE PRE-TREATMENT OF ALUMINUM COMPRISING PICKLING AND PASSIVATION

This invention relates to a method for anti-corrosion treatment of components produced from aluminium, comprising a pre-treatment stage and subsequent painting. The passivation of the pre-treatment stage includes bringing the components into contact with an acidic, aqueous composition based on water-soluble compounds of the elements Zr and/or Ti. The pickling and passivation are coordinated with each other so that a re-dosing of active components of the passivation solution can occur in substantial parts from the pickling solution.

In prior art, a variety of pre-treatment methods for components produced from aluminium, in particular strip materials, to provide protection against corrosion and paint adhesion are already known, these methods being based on acidic compositions. In these methods, the aluminium surface is usually freed from the oxide layer, which occurs naturally or due to the production process, by means of pickling. This pickling comprises not only the removal of the oxide layer, but also usually includes pickling the components produced from aluminium themselves, in order to provide a homogenous, reproducible metal surface for subsequent passivation. Recently, the demand for pre-treatments in the industrial series production of aluminium components has increased significantly, in which the use of chromium compounds for improved environmental compatibility and sustainability can be completely avoided.

The first international publication of patent application WO 00/68458 A1 describes a suitable, three-stage method for the pre-treatment of components produced from aluminium comprising acidic pickling, a rinse and acidic passivation based on the elements Zr and/or Ti, whereby the rinsing takes place between the pickling and passivation and preferably consists of several rinsing stages, within which the running rinsing water is directed over the component contrary to the direction of travel.

Based on this prior art, the task of this invention now is to optimise the pre-treatment stage for components produced from aluminium in the event of subsequent painting, with regard to process measures to help maintain a satisfactory pre-treatment result in the continuous operation of such a pre-treatment stage, as well as to reduce the complexity of the pre-treatment stage.

This task is resolved in an anti-corrosion treatment procedure for components produced from aluminium, comprising a pre-treatment stage and subsequent painting, so that in the pre-treatment stage, the component is initially brought into contact with an aqueous pickling solution that has a pH value of 1 to 3, a free acid content in points of at least 8 and a total fluoride content of at least 40 mmol/l, and it is then brought into contact with an aqueous passivation solution that has a pH value of 1 to 3, a free acid content in points of below 8 and a total fluoride content of less than 60 mmol/l but at least 5 mmol/l, and also contains less than 10 mmol/l but at least 0.1 mmol/l of water-soluble compounds of the elements Zr and/or Ti for each respective element, whereby in the pre-treatment stage the component is brought into contact with the passivation solution directly after it is brought into contact with the pickling solution.

Components produced from aluminium which undergo anti-corrosion treatment according to this invention are those in which the surfaces are formed of metal substrates and at least 80%, preferably at least 90%, even more preferably at least 95% of the substrate surfaces are aluminium and/or aluminium alloys, whereby according to the invention the aluminium alloys consist of more than 50 at. % aluminium. It is also preferable that the surfaces of the aluminium substrate do not contain any conversion coating with a coating weight of more than 10 mg/m$^2$ with regard to such foreign elements, the proportion of which is below 1 at. % in the aluminium substrate.

In the inventive method, suitable components produced from aluminium are selected, for example, from semi-finished products such as sheet metal, strips, coils or wires, or from complex three-dimensional production objects, which in turn are formed using strip material or sheet metal or manufactured in a die casting process.

A pre-treatment stage in the sense of this invention is a process stage that is separate from the application of paint, which comprises the process steps of pickling and passivation, which are separated from each other in terms of time, with the help of each fluid composition that is stored separately in the system tank in the form of a pickling solution and a passivation solution. In a preferred embodiment, the components produced from aluminium are pre-treated in series in the pre-treatment stage of the inventive method. A pre-treatment in series according to the invention consists of bringing a variety of components produced from aluminium into contact with each of the pickling and passivation solutions stored in the system tank, without the pickling and passivation solutions stored in the system tank being fully replaced with a new formulation after each pre-treatment of an individual component produced from aluminium.

The transfer of the component from the pickling solution to the passivation solution occurs "immediately". According to the invention, this means that the passivation occurs after the pickling without the intermediary stage of wetting the component with another fluid composition that does not represent a passivation solution in the sense of this invention. In a preferable procedure according to the invention, no such additional process step takes place between pickling and passivation which provides and uses technical means to dry or remove the aqueous film of fluid attached to the surface of the component, in particular by supplying thermal energy, applying a stream of air or stripping off the film of fluid mechanically. In a particularly preferable procedure according to the invention, the passivation which directly follows the pickling is carried out "wet-on-wet", i.e. in such a way that one wet film of a fluid composition that is stuck to the surface of the component, whereby the fluid composition is a pickling solution in the sense of this invention, is transferred into the passivation solution of the pre-treatment stage along with the component.

In the inventive method, during the continuous pre-treatment of a series of components produced from aluminium, strengthening the pickling by means of adding acids and compounds that are a source of fluoride ions ensures that essentially only water-soluble compounds of the elements Zr and/or Ti must be added in the passivation stage which immediately follows. The transfer of active components from the pickling solution alone, caused by the inevitable liquid film attached to the component, causes the same active components in the passivation solution, which are both consumed and removed here, to be at least partially replaced without it resulting in or risking any significant disadvantage regarding the results of the pre-treatment due to the transfer of aluminium salts, originating from the pickling process, into the passivation solution. To make the most of the transfer, in order to compensate for the active components consumed during passivation, it is advantageous if the ratio of pre-treated surfaces of non-liquid-transferring components produced from aluminium in square meters per minute to stored volumes of the passivation solution in cubic meters is at least 10, most preferably at least 50. Non-liquid-transferring components are characterised in that they do not transfer more than 1 liter of pickling solution per square meter of the pickled component surface into the passivation solution, for example flat products such as strips, sheet metal or wires.

The free acid content in points within the scope of this invention is determined by diluting 10 ml of pickling solution to 50 ml and titrated to a pH value of up to 3.6 using 0.1 N sodium hydroxide. The consumption of sodium hydroxide in milliliters indicates the pointage. In a preferred embodiment of the inventive method, the pickling solution has a free acid content of at least 12 points, to ensure that the removal of the oxide layer for this type of aluminium material to be treated is, as far as possible, done independently and to a sufficient extent for the subsequent passivation, for example in the series treatment of individual components, each produced from different aluminium materials, or in the series treatment of individual components produced from a mixture of different aluminium materials. On the other hand, the free acid pointage should preferably not be higher than 16 in order to keep the metal salts load in the pickling solution at a moderate level with an acceptable amount of effort to be made in the procedure.

As well as setting a free acid content in the pickling solution as a control parameter to provide, in the inventive process, the optimum pickled surfaces of components produced from aluminium, the presence of a certain buffering capacity or a certain level of acid reserves has proven to ensure the process is stable in series treatment. For this, the total acid content is important, and in the pickling solution of the inventive method this is preferably at least 15 points, however preferably no more than 20 points. According to the invention, the total acid content is determined similarly to the free acid, with the difference that it is titrated to a pH value of up to 8.5.

In a preferred inventive method, the pickling solution has a pH value of less than 2.0. Then it is also regularly ensured that sufficient pickling can take place in the pre-treatment stage.

With regard to the acid used in the pickling solution of the pre-treatment stage for setting the acid content, it has been ascertained that sulphuric acid is preferable. Similarly, in the inventive process, it is preferable to use pickling solutions in which the total acid content in points is formed of 80% sulphuric acid, particularly preferably 90% sulphuric acid, most preferably 95% sulphuric acid.

Another prerequisite for a sufficient pickling effect on the components produced using aluminium is the presence of fluorides in the pickling solution of the pre-treatment stage of the inventive process, as they are a chelating agent for aluminium ions which, on the one hand, remove the oxide coating layers and, on the other hand, stabilise the high load of aluminium ions in the pickling solution. Here, it is preferable if the total fluoride content in the pickling solution is at least 60 mmol/l. The total fluoride content in the scope of this invention is determined by means of a fluoride ion-sensitive electrode according to DIN 38 405-D-4-1.

Surprisingly, it transpired that the presence of layers of water-soluble compounds of the elements Zr and/or Ti formed during passivation inside the pickling solution is not disadvantageous, and hence a simple possibility arose in which the transfer of components requiring pre-treatment from the pickling solution into the passivation solution could take place "immediately", with transferred liquid from the pickling solution being at least partially replaced. However, it must always be ensured that the active components of the passivation solution, as elements to be transferred from the pickling solution, do not cause the formation of any layers in the pickling solution. This would be disadvantageous for the subsequent passivation in that the conversion coating, which is based on the elements Zr and/or Ti and would be formed under less-than-ideal conditions in the pickling solution, would be partially re-dissolved and reformed and therefore result in a less effective passivation of the components. It has been proven that in order to match this profile of requirements in a preferred method according to the invention, the pickling solution must contain at least 7 mmol/l of water-soluble compounds of the elements Zr and/or Ti with reference to each respective element to be able to make the most of the transfer replacing the parts of these elements consumed in the passivation solution. On the other hand, the number of these parts in the pickling solution should not exceed any value which enables the formation of a conversion coating based on the elements Zr and/or Ti. In this respect, it is preferable according to the invention if this type of pickling solution does not contain more than 30 mmol/l of water-soluble compounds of the elements Zr and/or Ti with reference to each respective element. In this context, avoiding the partial formation of a layer based on the elements Zr and/or Ti in the pickling solution is also preferable, if the molar ratio of the total proportion of water-soluble compounds of the elements Zr and/or Ti, regarding each respective element, to the total fluoride content in the pickling solution is smaller than 0.1.

In a preferred inventive method, the pickling solution also contains a surface-active organic compound, particularly preferably a non-ionic surfactant, whereby the proportion of surface-active organic substances in the pickling solution is preferably at least 0.1 mmol/l. In this context, the types of non-ionic surfactants that are generally preferred are those with an HLB value (Hydrophilic-Lipophilic-Balance) of at least 8, particularly preferably at least 10, most preferable at least 12, however particularly preferably no more than 18, most preferably no more than 16. The HLB value acts as a quantitative classification of non-ionic surfactants according to their internal molecular structure, whereby the non-ionic surfactants are divided into a lipophilic and a hydrophilic group. The HLB value can be placed on an arbitrary scale of 0 to 20 and, according to this invention, is calculated as follows:

$$HLB=20(1-M_L/M)$$

where $M_L$: molar mass of the lipophilic group of non-ionic surfactants

M: molar mass of the non-ionic surfactants

Particularly suitable non-ionic surfactants are chosen from alkoxylated alkyl alcohols, alkoxylated fatty amines and/or alkyl polyglycosides, particularly preferably from alkoxylated alkyl alcohols and/or alkoxylated fatty amines, most preferably from alkoxylated alkyl alcohols. The alkoxylated alkyl alcohols and/or alkoxylated fatty amines in this case are preferably end-capped, particularly preferably with an alkyl group, which in turn preferably does not have more than 8 carbon atoms, particularly preferably no more than 4 carbon atoms.

The pickling solution in the inventive method is preferably adjusted in such a way that for the wrought aluminium alloy EN AW-6060 (AlMgSi0.5) at 40° C. in an unaffected pickling solution of the inventive method, there is an oxide layer removal rate of at least 15 $mgm^{-2}s^{-1}$ with regard to the element aluminium.

In the passivation which occurs immediately after the pickling, in the inventive method a conversion coating based on the elements Zr and/or Ti is applied. For sufficient passivation it is preferable if, after the passivation, a coating layer is formed which is at least 5 $mg/m^2$, preferably at least 10 $mg/m^2$, particularly preferably at least 20 $mg/m^2$, however preferably not more than 50 $mg/m^2$, determined by means of x-ray fluorescence (XRF) analysis. For this, it is also preferable that the passivation solution of the inventive method contains at least 0.5 mmol/l, particularly preferably at least 1 mmol/l of water-soluble compounds of the elements Zr and/or Ti with reference to each element. In this context, for an effective coating formation based on the elements Zr and/or Ti, it is also preferable in the passivation if the molar ratio of the total amount of water-soluble compounds of the elements Zr and/or Ti with reference to each respective element to the total fluoride content in the passivation solution is at least 0.1, particularly preferably at least 0.4.

In a preferred form of the inventive method, the pH value of the passivation solution in the pre-treatment stage is at least 1.8, particularly preferably at least 2.0.

For sufficient passivation in the pre-treatment stage of the inventive method, it is not necessary for water-soluble compounds of the element chromium to be present. In another preferred version of the inventive method, the passivation solution therefore contains a total of less than 10 ppm of water-soluble compounds of the element chromium, calculated as Cr.

The application of the pickling and passivation solutions stored in the respective system tank of the pre-treatment stage can take place using all processes known from prior art, whereby immersion and spraying procedures are preferred for bringing the components produced from aluminium into contact with these solutions; particularly preferred is the spray method as a form of application.

The painting which takes place after the pre-treatment process includes, according to the invention, applying a composition containing a chemically or physically setting binding agent to form a coating layer on the pre-treated component produced from aluminium, whereby the painted coating layer, in its dried or set state, has a coating thickness of preferably at least one micrometer, particularly preferably of at least 10 μm, measured according to a wedge cutting process in accordance with DIN 50986:1979-03.

Suitable coating paints are autophoretic coatings, electrophoretic coatings, powder coatings and powder coatings as well as liquid coatings which can be applied using conventional means. With regard to the binding agent used, according to the invention, both coatings based on inorganic binding agents such as silicate or lime, and coatings based on organic binding agents can be used. According to the invention, the subsequent application of coatings based on organic binding agents is particularly beneficial, in particular those which contain less than 10 wt. % organic solvents which have a boiling point of below 150° C. at 1 bar. In this context, powder coatings are therefore preferred, in particular those with binding agents based on epoxy resins, carboxyl and hydroxyl group polyester resins and/or acrylate resins, which each provide an outstanding level of paint adhesion for the components produced from aluminium which have been pre-treated in accordance with the invention.

After pre-treatment and before the painting, the component produced from aluminium can be rinsed, which serves to remove a liquid film of passivation solution which is stuck to the surface before the coating is applied. Furthermore, it is usual for the component to be dried before the coating is applied. This is particularly the case when a powder coating is to be applied.

What is claimed is:

1. A method for anti-corrosion treatment of components at least partly produced from aluminum, comprising a pre-treatment stage and subsequent painting stage, wherein steps in the pre-treatment stage comprise:

a. contacting an aluminum component with an aqueous pickling solution that has a pH value of 1 to 3, a free acid content in points of at least 8 and a total fluoride content of at least 40 mmol/l; and b. contacting the component from step a) with an aqueous passivation solution that has a pH value of 1 to 3, a free acid content in points of below 8 and a total fluoride content of less than 60 mmol/l but at least 5 mmol/l, and also contains less than 10 mmol/l but at least 0.1 mmol/l of water-soluble compounds of the elements Zr and/or Ti for each respective element, whereby after the component is brought into contact with the pickling solution and before it is brought into contact with the passivation solution, no rinsing or drying step takes place.

2. The method according to claim 1, wherein the pickling solution has a free acid content in points of at least 12.

3. The method according to claim 1, wherein the pickling solution has a pH value of less than 2.

4. The method according to claim 1, wherein the pickling solution has a total acid content in points of at least 15.

5. The method according to claim 1, wherein the pickling solution also contains at least 7 mmol/l and not more than 30 mmol of water-soluble compounds of the elements Zr and/or Ti with reference to each respective element.

6. The method according to claim 5, wherein the pickling solution has a molar ratio of a total amount of the water-soluble compounds of the elements Zr and/or Ti, with reference to each respective element, to total fluoride content in the pickling solution of less than 0.1.

7. The method according to claim 1, wherein at least 80% of the points of the total acid content of the pickling solution is formed by sulphuric acid.

8. The method according to claim 1, wherein the pickling solution also contains a surface-active organic compound in an amount of at least 0.1 mmol/l.

9. The method according to claim 8, wherein the surface-active organic compound is a non-ionic surfactant.

10. The method according to claim 1, wherein the component is contacted with the pickling solution and/or the passivation solution by spraying.

11. The method according to claim 1, further comprising a step of wherein after the passivation step and before the painting stage, a rinsing step is performed.

12. The method according to according to claim 1, wherein after the pre-treatment stage and, optional rinsing step, the component is coated with a powder coating.

* * * * *